US007358022B2

(12) United States Patent
Farrugia et al.

(10) Patent No.: US 7,358,022 B2
(45) Date of Patent: Apr. 15, 2008

(54) CONTROL OF PARTICLE GROWTH WITH COMPLEXING AGENTS

(75) Inventors: Valerie M. Farrugia, Oakville (CA); Allan K. Chen, Oakville (CA); Kimberly Nosella, Mississauga (CA); Raj D. Patel, Oakville (CA); Tie Hwee Ng, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 518 days.

(21) Appl. No.: 11/094,428

(22) Filed: Mar. 31, 2005

(65) Prior Publication Data

US 2006/0222990 A1 Oct. 5, 2006

(51) Int. Cl.
*G03G 5/00* (2006.01)

(52) U.S. Cl. ..... 430/137.14; 523/335

(58) Field of Classification Search ..... 430/137.14; 523/335

See application file for complete search history.

(56) References Cited

U.S. PATENT DOCUMENTS

| | | | | |
|---|---|---|---|---|
| 5,593,807 | A | 1/1997 | Sacripante et al. | |
| 5,916,725 | A | 6/1999 | Patel et al. | |
| 6,495,302 | B1 | 12/2002 | Jiang et al. | |
| 6,541,175 | B1 | 4/2003 | Jiang et al. | |
| 6,582,873 | B2 | 6/2003 | Jiang et al. | |
| 7,037,633 | B2 * | 5/2006 | Hopper et al. | 430/137.14 |
| 2002/0187416 | A1 | 12/2002 | Jiang et al. | |
| 2003/0165767 | A1 | 9/2003 | Patel et al. | |
| 2004/0142266 | A1 | 7/2004 | Sacripante et al. | |
| 2005/0255402 | A1 * | 11/2005 | Hopper et al. | 430/137.14 |
| 2006/0115758 | A1 | 6/2006 | Chang et al. | |

FOREIGN PATENT DOCUMENTS

| | | |
|---|---|---|
| EP | 1 441 260 | 7/2004 |

OTHER PUBLICATIONS

U.S. Appl. No. 11/037,214, filed Jan. 19, 2005, Patel et al.

* cited by examiner

*Primary Examiner*—Mark A Chapman
(74) *Attorney, Agent, or Firm*—OLiff & Berridge, PLC

(57) ABSTRACT

A method of making particles suitable for use as toners includes forming a mixture of sulfonated polyester resin, a colorant dispersion and optionally a wax dispersion, homogenizing the mixture, adding a coagulant to the mixture to aggregate the mixture to form aggregated particles, and coalescing the aggregated particles to form coalesced particles. In the method, when a predetermined average particle size is achieved during the aggregation and/or coalescing step, a complexing agent that complexes with ions of the coagulant is added in an amount effective to substantially halt any further particle growth. The complexing agent is believed to halt further growth by complexing with free coagulant ions still in the solution.

21 Claims, No Drawings

CONTROL OF PARTICLE GROWTH WITH COMPLEXING AGENTS

BACKGROUND

Described herein are methods for controlling particle growth through the use of complexing agents. More in particular, described are methods of making sulfonated polyester based toner particles, specifically alkali metal sulfonated polyester based toner particles, more specifically bimodal alkali metal sulfonated polyester based toner particles, via emulsion aggregation in which a complexing agent is introduced in order to halt additional aggregation of particles once a predetermined desired particle size is reached.

Small sized toner particles, such as having average particle sizes of from about 3 to about 15 micrometers, preferably from about 5 to about 10 micrometers, more preferably from about 6 to about 9 micrometers, are desired, especially in xerographic engines wherein high resolution is a characteristic. Toners with the aforementioned small sizes can be economically prepared by chemical processes, which involve the conversion of emulsion sized particles to toner composites by aggregation and coalescence, or by suspension, microsuspension or microencapsulation processes.

It has been found that sulfonated polyester resins, and in particular alkali metal sulfopolyester resins, may advantageously be used as the binder material for toner particles. See, for example, U.S. Pat. No. 5,916,725, which describes a process for the preparation of toner comprising mixing an amine, an emulsion latex containing sulfonated polyester resin, and a colorant dispersion, heating the resulting mixture, and optionally cooling.

Illustrated in U.S. Pat. No. 5,593,807, the disclosure of which is totally incorporated herein by reference in its entirety, is a process for the preparation of toner compositions comprising, for example, (i) preparing an emulsion latex comprised of sodio sulfonated polyester resin particles of from about 5 to about 500 nanometers in size diameter by heating the resin in water at a temperature of from about 65° C. to about 90° C.; (ii) preparing a pigment dispersion in water by dispersing in water from about 10 to about 25 weight percent of sodio sulfonated polyester and from about 1 to about 5 weight percent of pigment; (iii) adding the pigment dispersion to the latex mixture with shearing, followed by the addition of an alkali halide in water until aggregation results as indicated, for example, by an increase in the latex viscosity of from about 2 centipoise to about 100 centipoise; (iv) heating the resulting mixture at a temperature of from about 45° C. to about 55° C. thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying.

It has also been recently found that advantageous toner particles may be obtained through the use of binder comprised of a combination of amorphous sulfonated polyester materials, including linear and/or branched polyesters, and crystalline sulfonated polyester materials. See, for example, U.S. patent application Ser. Nos. 10/998,822, filed Nov. 30, 2004, and 11/037,214, filed Jan. 19, 2005, each incorporated herein by reference in their entireties.

As described in the foregoing patent properties, sulfonated polyester materials are most advantageously formed into particles having a size within the desired toner particle size range by the known emulsion/aggregation/coalescence technique. Emulsion/aggregation/coalescing processes for the preparation of toners are illustrated in a number of Xerox patents, the disclosures of which are totally incorporated herein by reference, such as U.S. Pat. Nos. 5,290,654, 5,278,020, 5,308,734, 5,346,797, 5,370,963, 5,344,738, 5,403,693, 5,418,108, 5,364,729, and 5,346,797.

U.S. Pat. Nos. 6,495,302 and 6,582,873, incorporated herein by reference in their entireties, each describe a toner process including, for example, mixing a latex with a colorant wherein the latex contains resin and an ionic surfactant, and the colorant contains a surfactant and a colorant; adding a polyaluminum chloride coagulant; affecting aggregation by heating; adding a chelating component and a base wherein the base increases the pH of the formed aggregates; heating the resulting mixture to accomplish coalescence; and isolating the toner. The latex is described to contain a resin selected from the group consisting of poly(styrene-butadiene), poly(methylstyrene-butadiene), poly(methyl methacrylatebutadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitdle), and poly(styrene-butyl acrylate-acrylononitrile-acrylic acid). Polyester resins, much less sulfonated polyester resins, are not described.

SUMMARY

In making sulfonated polyester based particles, particularly in making hydrophobic alkali metal sulfonated polyester based particles that include branched amorphous and/or crystalline components, it has been very difficult to control the growth of the particle size in the emulsion formation process so as to be at or near a predetermined desired particle size. This is because even when the particle growth phase is halted as rapidly as possible using conventional techniques, additional uncontrolled particle growth occurs.

What is still desired is an improved method to provide polyester based particles, in particular bimodal sulfonated polyester based particles, in which the particle growth can be more precisely controlled so as to be at or substantially near a predetermined desired particle size. By "bimodal" as used herein is meant that the binder is comprised of two or more distinct materials having different molecular weights.

In this regard, in embodiments described herein, a method comprises forming an emulsion comprising sulfonated polyester resin, a colorant and optionally a wax, homogenizing the emulsion, adding a coagulant to the emulsion and aggregating to form aggregated particles, and coalescing the aggregated particles to form coalesced particles, wherein when a predetermined average particle size is achieved during the aggregation and/or coalescing steps, an agent is added in an amount effective to complex with substantially all of free coagulant ions remaining in the emulsion. Addition of the agent substantially halts further growth of the particles, thereby permitting increased control over the process and the particle sizes obtained therefrom.

DETAILED DESCRIPTION OF EMBODIMENTS

As was mentioned above, although toner particles comprised of sulfonated polyester resin binders are desired, it has proven difficult to effectively control the growth size of sulfonated polyester based particles in the emulsion aggregation process, particularly with sulfonated polyester resins comprised of branched amorphous polyester resin and/or crystalline polyester resin. During coalescence of the particles, i.e., the stage where the particles are heated so that particle aggregates melt together to form an end particle of desired shape, additional growth occurs in the sulfonated polyester particles. Bimodal sulfonated polyester particles have been found to be particularly susceptible to uncontrolled particle growth during coalescence. An increase of even 2° C. during coalescence or prolonging the coalescence heating in order to obtain particles of desired shape factor may result in additional growth of particles of about 0.5 to about 1 micrometer and loss of geometric size distribution (GSD).

In the case of carboxylic acid based resin particles grown via emulsion polymerization, it has been proven successful to prevent uncontrolled particle growth during coalescence by adding a base to generate a negative surface charge from the carboxylic acid groups. This technique, however, has not been successful with sulfonated polyesters because the negative charge generated by the base is not the same as with carboxylic acid groups.

One technique that has been attempted to freeze particle size during aggregation is to add a surfactant, preferably an anionic surfactant, to the aggregated particles. See, for example, U.S. Pat. No. 5,593,807, incorporated herein by reference in its entirety. However, this technique has not proven entirely reliable.

Another technique used to try and control particle growth is to try and drop the reactor temperature as quickly as possible, e.g., by quenching, and hope that the additional particle growth that occurs during quenching is as minimal as possible so that the end particles obtained still are within specified size and GSD requirements. This technique is also unreliable, and relies on very tight process controls.

In researching the problem of uncontrolled particle growth with sulfonated polyester based resins, it has been found by the present inventors that the problem arises from the metal ions in solution provided by the coagulant. For example, when zinc acetate is used as the coagulant, a high concentration of zinc ions is placed in the solution and associated with the particles. The concentration of zinc ions in the particle and in the solution is a function of the pH of the mixture and the temperature. In aggregation and coalescence conditions, it has been found that over 50% of the zinc ions may remain free in the solution. It is speculated that these free ions result in further particle growth when the temperature is either raised or prolonged during coalescence, the coagulant ions reacting with the sulfonated polyester to encourage additional aggregation.

As a result of this discovery, it was determined by the present inventors that if the coagulant ions in the solution could be neutralized once the desired particle size is reached, additional uncontrolled particle growth might be avoided. As a result, the present subject matter was derived.

In embodiments, the binder of the particles is comprised of a polyester resin, preferably a sulfonated polyester resin, more preferably an alkali metal sulfonated polyester resin, and most preferably a lithium sulfonated polyester resin.

While the process in embodiments may be applicable to any sulfonated polyester, in general the sulfonated polyesters may have the following general structure, or random copolymers thereof in which the n and p segments are separated.

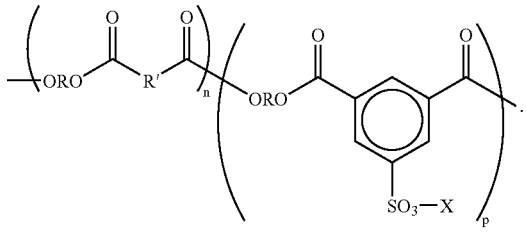

In the formula, R is an alkylene of, for example, from 2 to about 25 carbon atoms, such as ethylene, propylene, butylene, oxyalkylene diethyleneoxide, and the like. R' is an arylene of, for example, from about 6 to about 36 carbon atoms, such as a benzylene, bisphenylene, bis(alkyloxy) bisphenolene, and the like. The variables p and n represent the number of randomly repeating segments, such as for example from about 10 to about 100,000. X represents an alkali metal such as sodium, lithium and the like.

A linear amorphous alkali sulfopolyester preferably may have a number average molecular weight (Mn) of from about 1,500 to about 50,000 grams per mole and a weight average molecular weight (Mw) of from about 6,000 grams per mole to about 150,000 grams per mole as measured by gel permeation chromatography (GPC) and using polystyrene as standards. A branched amorphous polyester resin, in embodiments, may possess, for example, a number average molecular weight (Mn), as measured by GPC, of from about 5,000 to about 500,000, and may be from about 10,000 to about 250,000, a weight average molecular weight (Mw) of, for example, from about 7,000 to about 600,000, and may be from about 20,000 to about 300,000, as determined by GPC using polystyrene standards. The molecular weight distribution (Mw/Mn) is, for example, from about 1.5 to about 6, and more specifically, from about 2 to about 4. The onset glass transition temperature (Tg) of the resin as measured by a differential scanning calorimeter (DSC) is, in embodiments, for example, from about 55° C. to about 70° C., and more specifically, from about 55° C. to about 67° C.

In embodiments, the alkali metal sulfonated polyesters may be amorphous, including both branched (crosslinked) and linear, crystalline, or a combination of the foregoing. Most preferably, the alkali metal sulfonated polyester may be comprised of a mixture of about 10 to about 50% by weight crystalline material and about 50 to about 90% by weight amorphous branched material. However, more or less of each component may be used as desired, and the mixture may also be made to further include amorphous linear polyester, for example in amount up to about 90% by weight. Any of the sulfonated polyesters and combinations described in U.S. patent application Ser. Nos. 10/998,822, filed Nov. 30, 2004, and 11/037,214, filed Jan. 19, 2005, each incorporated herein by reference in their entireties, may be used herein without restriction.

Examples of amorphous, linear or branched, alkali metal sulfonated polyester based resins include, but are not limited to, copoly(ethylene-terephthalate)-copoly-(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion. Examples of crystalline alkali sulfonated polyester based resins alkali copoly(5-sulfoisophthaloyl)-co-poly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), and alkali copoly(5-sulfo-iosphthaloyl)-copoly(octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-co-poly(butylene-adipate), alka copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly (ethylene-succinate), alkali copoly(5-sulfoisophthaloyl-copoly(butylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly (butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-iosphthaloyl)-copoly(butylene-adipate), alkali copoly(5-sulfo-isophthaloyl)-copoly(pentylene-adipate), alkali copoly(5-sulfo-isophthaloyl)copoly (hexylene-adipate), poly(octylene-adipate), and wherein the alkali is a metal like sodium, lithium or potassium. In embodiments, the alkali metal is lithium.

Crystalline sulfonated polyester, as used herein, refers to a sulfonated polyester polymer having a three dimensional order. By crystalline is meant that the sulfonated polyester has some degree of crystallinity, and thus crystalline is intended to encompass both semicrystalline and fully crystalline sulfonated polyester materials. The polyester is considered crystalline when it is comprised of crystals with a regular arrangement of its atoms in a space lattice.

In addition to the aforementioned binder, the particles further include at least one colorant. Various known suitable colorants, such as dyes, pigments, and mixtures thereof, may be included in the toner in an effective amount of, for example, about 1 to about 25 percent by weight of the toner, and preferably in an amount of about 1 to about 15 weight percent. As examples of suitable colorants, which is not intended to be an exhaustive list, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Optionally, the particles may also include a wax. When included, the wax is preferably present in an amount of from about, for example, 1 weight percent to about 25 weight percent, preferably from about 5 weight percent to about 20 weight percent, of the toner particles. Examples of suitable waxes include, but are not limited to polypropylenes and polyethylenes commercially available from Allied Chemical and Petrolite Corporation (e.g., POLYWAX™ polyethylene waxes from Baker Petrolite), wax emulsions available from Michaelman, Inc. and the Daniels Products Company, EPOLENE N-15™ commercially available from Eastman Chemical Products, Inc., VISCOL 550-P™, a low weight average molecular weight polypropylene available from Sanyo Kasei K. K., CARNUBA Wax and similar materials. Examples of functionalized waxes include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical and Petrolite Corporation and SC Johnson wax.

The toner particles of embodiments may also contain other optional additives, as desired or required. For example, the particles may include positive or negative charge enhancing additives, preferably in an amount of about 0.1 to about 10, and more preferably about 1 to about 3, percent by weight of the toner. Examples of these additives include quaternary ammonium compounds inclusive of alkyl pyridinium halides; alkyl pyridinium compounds, reference U.S. Pat. No. 4,298,672, the disclosure of which is totally incorporated hereby by reference; organic sulfate and sulfonate compositions, reference U.S. Pat. No. 4,338,390, the disclosure of which is totally incorporated hereby by reference; cetyl pyridinium tetrafluoroborates; distearyl dimethyl ammonium methyl sulfate; aluminum salts such as BONTRON E84™ or E88™ (Hodogaya Chemical); and the like.

There can also be blended with the toner particles external additive particles including flow aid additives, which additives may be present on the surface of the toner particles. Examples of these additives include metal oxides like titanium oxide, tin oxide, mixtures thereof, and the like; colloidal silicas, such as AEROSIL®, metal salts and metal salts of fatty acids inclusive of zinc stearate, aluminum oxides, cerium oxides, and mixtures thereof. Each of the external additives may be present in an amount of from about 0.1 percent by weight to about 5 percent by weight, and more specifically, in an amount of from about 0.1 percent by weight to about 1 percent by weight, of the toner. Several of the aforementioned additives are illustrated in U.S. Pat. Nos. 3,590,000, 3,800,588, and 6,214,507, the disclosures of which are totally incorporated herein by reference.

In embodiments, a method of making particles including sulfonated polyester resin binder includes first forming a mixture of an emulsion of the sulfonated polyester resin, a dispersion of the colorant, and optionally a dispersion of the wax. Dispersions of any other additives to be included in the particles may also be added to the mixture.

In embodiments, the pH of the mixture may be adjusted to between about 3 to about 5. The pH of the mixture may be adjusted by addition of an acid such as, for example, acetic acid, nitric acid or the like. The addition may also be made to one or more of the individual components of the mixture before inclusion in the mixture, such that no further adjustment of pH is required after formation of the mixture.

Additionally, in embodiments, the mixture is preferably homogenized. Homogenization may be accomplished by mixing at about 600 to about 4,000 revolutions per minute using any suitable device and equipment. Homogenization may thus be accomplished by any suitable means, including, for example, using an IKA ULTRA TURRAX T50 probe homogenizer.

After any suitable or desired amount of homogenization time, a coagulant is introduced into the mixture. Any metal salt may be used as the coagulant herein. Preferably, the metal salt is water soluble and has an appropriate dissociation constant such that sufficient metal ions are placed in the solution in order to effect aggregation of the particles. The metal salt is preferably added to the mixture as an aqueous solution.

Examples of coagulants that may be used include any suitable metal salt having the aforementioned properties. Specific non-limiting examples include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like.

In a preferred embodiment, the alkali metal sulfonated polyester is a lithio sulfonated polyester, which is a particularly hydrophobic polyester, although the subject matter is not intended to be limited to such preferred material. In this case, the coagulant used to aggregate the particles is preferably a zinc-containing coagulant, most preferably zinc acetate.

Preferably, the coagulant is used in an amount of about 0.5 to about 5% by weight of the toner resin. More in particular, in embodiments, the coagulant is added in amounts of from about 0.5 to about 4% by weight of the toner resin.

In order to control aggregation of the particles, the coagulant is preferably metered into the mixture over time. For example, the coagulant may be metered into the mixture over a period of from about 5 to about 120 minutes, although more or less time may be used as desired or required. Most preferably, the addition of the coagulant is done while the mixture is maintained under stirred, preferably high shear, conditions, although the subject matter is not limited to such addition. For example, the coagulant may be added while the same stirring conditions as present for the homogenization are maintained.

The particles are then permitted to aggregate until a predetermined desired particle size is obtained. By this is meant that a desired particle size to be obtained is determined prior to the method, and the particle size is monitored during the growth process until such particle size is reached. Samples are preferably taken during the growth process and analyzed, e.g., with a Coulter Counter, for average particle size. Once the predetermined desired particle size is reached, then the growth process is halted. In preferred embodiments, the predetermined desired particle size is within the toner particle size ranges mentioned above.

The growth and shaping of the particles following addition of the coagulant may be accomplished under any suitable conditions. Preferably, the growth and shaping is conducted under conditions in which aggregation occurs separate from coalescence. For separate aggregation and coalescence particle formation steps, the aggregation step is preferably conducted under shearing conditions at a temperature of from about 35° C. to about 65° C. Following aggregation to the desired particle size, the particles may then be coalesced to the desired final shape, the coalescence being effected by heating the mixture to a temperature of from about 55° C. to about 75° C. Of course, higher or lower temperatures may be used without limitation, it being understood that the temperature is a function of the resins used for the binder.

Upon the particles reaching the predetermined desired particle size, it is then desired to halt further growth of the particles. However, as mentioned above, further uncontrolled and undesired growth has been found to occur as the heating is continued for coalescing the particles to a desired final shape. To address this issue, in embodiments, a complexing agent for the metal ion of the coagulant is preferably introduced once the predetermined particle size is reached.

Without being bound by theory, it is believed that the cause of the uncontrolled growth is the continued presence of excess metal ions of the coagulant in the solution, which ions continue to encourage aggregation of the particles, resulting in larger particles being formed and GSD being made to be out of specification. The complexing agent is believed to complex with these free ions in the solution, and/or the free ions on the particles in solution, thereby preventing the ions from participating in further aggregation of the particles. In particular, the complexing agent reacts with the free metal ions to deactivate the metal ions, thus preventing further reaction with the sulfonated sites on the polyester particle surfaces, and thus further growth. The complexing agents may also deactivate the alkali metal of the sulfonated polyester, similarly preventing further growth of the particles as detailed above. The uncontrolled growth experienced in prior processes is thus substantially eliminated in the present method.

As the complexing agent, any agent capable of forming a complex with the metal ions of the coagulant may be used without limitation. As non-limiting specific examples, mention may be made of ethylenediamine tetraacetic acid (EDTA), ethylene diamine disuccininc acid, nitrilotriacetate, methylglycinediacetic acid, glutamate-N,N-bis(carboxymethyl), carboxymethylchitosan (under biscarboxymethyl umbrella), dimercaptosuccinic acid (DMSA), diethylenetriaminepentaacetate (DTPA) and mixtures thereof In embodiments, the complexing agent is preferably ethylenediamine tetraacetic acid.

The complexes formed by the complexing agents are water-soluble and do not interfere with the emulsion aggregation process or the properties of the resulting particles.

In embodiments, the complexing agent is added to the mixture in a solution. Although not necessary, it may be preferable to include in the solution a pH-adjusting base that acts to increase the pH of the mixture. For example, in preferred embodiments, the complexing agent is added in a solution of a base such as sodium hydroxide, potassium hydroxide, ammonium hydroxide, sodium carbonate, sodium bicarbonate, mixtures thereof and the like. Preferably, the complexing agent is dissolved in the base at concentrations of from about 0.5 to about 10 weight percent relative to the weight of the complexing agent in the solution. Alternatively, the complexing agent is dissolved in a solution including about 0.5 to about 1.0M of a base. The pH of the mixture is thereby adjusted to be between about 4 and about 7, preferably to between about 4 and about 6, upon addition of the complexing agent.

The complexing agent is preferably added to the mixture in an amount effective to substantially halt any further particle growth. In this regard, the complexing agent is preferably added to the mixture in an amount of from about 0.01 to about 8% by weight of the solids in the mixture, preferably from about 0.5 to about 6% by weight of the solids of the mixture.

After coalescence, the mixture is cooled to room temperature. The cooling may be rapid or slow, as desired. A suitable cooling method may comprise introducing cold water to a jacket around the reactor. After cooling, the mixture of toner particles is preferably washed with water and then dried. Drying may be accomplished by any suitable method for drying, including freeze-drying. Freeze drying is typically accomplished at temperatures of about −80° C. for a period of about 72 hours.

The process may or may not include the use of surfactants, emulsifiers, and pigment dispersants.

Upon aggregation and coalescence, the particles comprised of the sulfonated polyester preferably have an average particle size of about 3 to about 15 micrometers, preferably about 5 to about 10 micrometers, more preferably about 6 to about 9 micrometers, with a GSD of about 1.05 to about 1.35, preferably about 1.10 to about 1.30. Herein, the geometric size distribution is defined as the square root of D84 divided by D16, and is measured by a Coulter Counter. The particles have a relatively smooth particle morphology and have a shape factor corresponding to a substantially spherical shape.

Following formation of the toner particles, the aforementioned external additives may be added to the toner particle surface by any suitable procedure such as those well known in the art.

The present toners are sufficient for use in an electrostatographic or xerographic process. In this regard, the toner particles of all embodiments are preferably formulated into a developer composition. Preferably, the particles are mixed with carrier particles to achieve a two-component developer composition. Preferably, the toner concentration in each developer ranges from, for example, 1 to 25%, more preferably 2 to 15%, by weight of the total weight of the developer.

Illustrative examples of carrier particles that can be selected for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluoroethylenes, other known coatings and the like. Where toners of the present invention are to be used in conjunction with an image developing device employing roll fusing, the carrier core may preferably be at least partially coated with a polymethyl methacrylate (PMMA) polymer having a weight average molecular weight of 300,000 to 350,000, e.g., such as commercially available from Soken. The PMMA is an electropositive polymer in that the polymer that will generally impart a negative charge on the toner with which it is contacted. The coating preferably has a coating weight of from, for example, 0.1 to 5.0% by weight of the carrier, preferably 0.5 to 2.0% by weight. The PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with from, for example, between about 0.05 to about 10 percent by weight, more preferably between about 0.05 percent and about 3 percent by weight, based on the weight of the coated carrier particles, of polymer until adherence thereof to the carrier core by mechanical impaction and/or electrostatic attraction. Various effective suitable means can be used to apply the polymer to the surface of the carrier core particles, e.g., cascade roll mixing, tumbling, milling, shaking, electrostatic powder cloud spraying, fluidized bed, electrostatic disc processing, and with an electrostatic curtain. The mixture of carrier core particles and polymer is then heated to enable the polymer to melt and fuse to the carrier core particles. The coated carrier particles are then cooled and thereafter classified to a desired particle size.

The carrier particles can be mixed with the toner particles in various suitable combinations. However, best results are obtained when about 1 part to about 5 parts by weight of toner particles are mixed with from about 10 to about 300 parts by weight of the carrier particles.

In embodiments, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein. Once the image is formed with toners/developers of the invention via a suitable image development method such as any one of the aforementioned methods, the image is then transferred to an image receiving medium such as paper and the like. In an embodiment of the present invention, it is desired that the toners be used in developing an image in an image-developing device utilizing a fuser roll member. Fuser roll members are contact fusing devices that are well known in the art, in which heat and pressure from the roll are used in order to fuse the toner to the image-receiving medium. Typically, the fuser member may be heated to a temperature just above the fusing temperature of the toner, i.e., to temperatures of from about 80° C. to about 150° C. or more.

Toner compositions and process for producing such toners according to the described embodiments are further illustrated by the following examples. The examples are intended to be merely further illustrative of the described embodiments.

Table 1 highlights four Examples. Example 4 is deemed the most successful or effective process for controlling particle growth, narrowing the geometric standard deviation (GSD) and reducing fines (as calculated by Coulter counter) as population fines (1.3-4.0 μm)). Each of the four example toners comprised 80% by weight of 1.5% lithio sulfonated branched sulfonated polyester and 20% by weight lithio sulfonated crystalline polyester.

TABLE 1

| | Example | | | |
|---|---|---|---|---|
| | 1 | 2 | 3 | 4 |
| Details | 3 wt % Zn (pH adjusted) and slurry adjusted with NaOH to stop growth | Lowered Zn from 3 to 2 wt % to control growth | Lowered Zn to 1 wt %, slurry was pH adjusted, and increased rpm | 2.5 wt % Zn, slurry was pH adjusted, and EDTA/NaOH used to halt growth |
| Initial pH Adjustment | No, pH = 4.84 | No, pH = 4.79 | Yes to 4.0 | Yes to 4.0 |
| rpm Range | 700 | 700 | 800 | 700 |
| Temperature Range | 40-69° C. | 40-69° C. | 40-73° C. | 40-72° C. |
| Total Zn to resin used | 3.0% | 2.0% | 1.0% | 2.5% |
| pH adjustment of Zn | Yes to 4.25 | Yes to 4.42 | Yes to 4.03 | Yes to 4.34 |
| Freezing agent | pH adjusted to 5.19 with 1M NaOH | pH adjusted to 5.51, then 6.39 with 1M LiOH | 0.6 wt % Neogen RK relative to resin and pH adjusted to 6.32 with 1M LiOH | Added 2 g EDTA in 1M NaOH solution (3 wt %), pH shifted to 5.64 |
| Final D50 | 11.47 μm | 9.27 μm | 10.43 μm | 6.82 μm |
| Final GSD | 1.30 | 1.26 | 1.39 | 1.24 |
| Population Fines | 6.78% | 4.76% | 60.5% | 5.17% |

EXAMPLE 1

In a 2 L Nalgene beaker, 531.6 grams of 18 percent by weight of the branched 1.5% lithio-sulfonated polyester resin (Tg=61.1° C.) and 237.2 grams of 10.6 percent by weight of the crystalline 1.5% lithio-sulfonated polyester resin, both emulsified via a solvent flashing method with acetone, were mixed together. To this was added 61.0 grams of 20.7 percent by weight of a Carnauba wax dispersion, as well as 31.7 grams of a cyan pigment dispersion containing 26.5 percent by weight of Pigment Blue 15:3 (made with Neogen RK surfactant). An additional 399.3 g of deionized water was added to the slurry making the overall toner solids in the final slurry to equal 10.26%. After uniform mixing, the pH of the slurry was measured to be 4.84 and was not adjusted. The 3.0% wt. zinc acetate dehydrate solution (3.57 g zinc acetate dehydrate in 112.6 g deionized water), which was adjusted from pH 6.7 to 4.25 with 4.34 g concentrated acetic acid, was added at ambient temperature via a peristaltic pump over 16 minutes to the pre-toner slurry while homogenizing the slurry with an IKA Ultra Turrax T50 probe homogenizer at 3000 rpm. As the slurry began to thicken, the homogenizer rpm was increased to 4000 while shifting the beaker side-to-side. The $D_{50}$ and GSD (by volume) were measured to be 3.93 and 1.38, consecutively, with the Coulter Counter Particle Size Analyzer.

This 1.4 L solution was charged into a 2 liter Büichi equipped with a mechanical stirrer containing two P4 45 degree angle blades. The heating was programmed to reach 40° C. over 30 minutes with stirring at 700 revolutions per minute. After 24 minutes at 40° C., the $D_{50}$ particle size of the toner had already reached 4.96 μm, but as aggregates and not coalesced particles. At 31 minutes into the reaction, the temperature was increased to 50° C.; the $D_{50}$ particle size reached 9.18 μm after 99 minutes at that temperature. The reaction was cooled overnight after a total time of 136 minutes and restarted the next day. Next day, the pH of the slurry was increased from 4.47 to 5.19 with 23.4 grams of 1M NaOH. The temperature of the reactor was then increased to 60° C. over 30 minutes. After the 30 minutes, the temperature was further increased to 66° C. and then 70° C., so that the aggregates would properly coalesce into spherical particles. The reaction was turned off or heating was stopped once the particles coalesced at 69° C. with a total reaction time of 208 minutes. The toner slurry was fast cooled by replacing hot water with cold in the circulating water bath, while still stirring the slurry at 700 rpm. A sample (about 0.25 gram) of the reaction mixture was then retrieved from the Büichi, and a $D_{50}$ particle size of 11.47 microns with a GSD of 1.30 was measured by the Coulter Counter. The product was filtered through a 25 micron stainless steel screen (#500 mesh), left in its mother liquor and settled overnight. Next day the mother liquor, which contained fines, was decanted from the toner cake that settled to the bottom of the beaker. The settled toner was reslurried in 1.5 liter of deionized water, stirred for 30 minutes, and then settled again overnight. This procedure was repeated once more until the solution conductivity of the filtrate was measured to be about 11.2 microsiemens per centimeter, which indicated that the washing procedure was sufficient. The toner cake was redispersed into 300 milliliters of deionized water, and freeze-dried over 72 hours. The final dry yield of toner is estimated to be 60% of the theoretical yield.

EXAMPLE 2

In a 2 L Nalgene beaker, 529.8 grams of 18 percent by weight of the branched 1.5% lithio-sulfonated polyester resin (Tg=61.1° C.) and 201.0 grams of 11.8 percent by weight of the crystalline 1.5% lithio-sulfonated polyester resin, both emulsified via the solvent flashing method with acetone, were mixed together. To this was added 61.0 grams of 20.7 percent by weight of a Carnauba wax dispersion, as well as 31.7 grams of a cyan pigment (Cyan 15:3). An additional 507.1 g of deionized water was added to the slurry making the overall toner solids in the final slurry to equal 9.96%. After uniform mixing, the pH of the slurry was measured to be 4.79 and was not adjusted. The 2.0% wt. zinc acetate dehydrate solution (2.38 g zinc acetate dehydrate in 70.7 g deionized water), which was adjusted from pH 6.78 to 4.42 with 1.97 g concentrated acetic acid, was added at ambient temperature via a peristaltic pump over 10 minutes to the pre-toner slurry while homogenizing the slurry with an IKA Ultra Turrax T50 probe homogenizer at 3000 rpm. As the slurry began to thicken, the homogenizer rpm was increased to 4000 while shifting the beaker side-to-side. The $D_{50}$ and GSD (by volume) were measured to be 4.05 and 1.60, consecutively, with the Coulter Counter Particle Size Analyzer.

This 1.4 L solution was charged into a 2 liter Büichi equipped with a mechanical stirrer containing two P4 45 degree angle blades. The heating was programmed to reach 40° C. over 30 minutes with stirring at 700 revolutions per minute. After 12 minutes at 40° C., the $D_{50}$ particle size of the toner had already reached 4.96 μm, but as aggregates and not coalesced particles. At 17 minutes into the reaction, the temperature was increased to 45° C.; the $D_{50}$ particle size reached 5.88 μm after 23 minutes at this temperature. At 47 minutes into the reaction, the pH of the slurry was increased from 4.65 to 5.51 with 24.23 grams of 1M LiOH. The temperature of the reactor was then increased to 50° C. and then again to 55° C.; the $D_{50}$ particle size reached 6.54 μm. At 83 minutes into the reaction, the pH of the slurry was again increased from 5.47 to 6.39 with 11.78 g 1M LiOH. After 5 minutes, the temperature was further increased to 60° C. and then 70° C., so that the aggregates would properly coalesce into spherical particles. The rpm was also increased to 850 at this point to slow down particle growth. The reaction was turned off or heating was stopped once the particles coalesced at 69° C. with a total reaction time of 144 minutes. The toner slurry was fast cooled by replacing hot water with cold in the circulating water bath, while stirring the slurry at 850 rpm. A sample (about 0.25 gram) of the reaction mixture was then retrieved from the Büichi, and a $D_{50}$ particle size of 9.27 microns with a GSD of 1.26 was measured by the Coulter Counter. The product was filtered through a 25 micron stainless steel screen (#500 mesh), left in its mother liquor and settled overnight. The next day the mother liquor, which contained fines, was decanted from the toner cake that settled to the bottom of the beaker. The settled toner was reslurried in 1.5 liter of deionized water, stirred for 30 minutes, and then settled again overnight. This procedure was repeated once more until the solution conductivity of the filtrate was measured to be about 6.9 microsiemens per centimeter, which indicated that the washing procedure was sufficient. The toner cake was redispersed into 300 milliliters of deionized water, and freeze-dried over 72 hours. The final dry yield of toner is estimated to be 56% of the theoretical yield.

EXAMPLE 3

In a 2 L Nalgene beaker, 529.8 grams of 18 percent by weight of the branched 1.5% lithio-sulfonated polyester resin (Tg=61.1° C.) and 201.0 grams of 11.8 percent by weight of the crystalline 1.5% lithio-sulfonated polyester resin, both emulsified via the solvent flashing method with acetone, were mixed together. To this was added 61.0 grams of 20.7 percent by weight of a Camauba wax dispersion, as well as 31.7 grams of a cyan pigment dispersion containing 26.5 percent by weight of Pigment Blue 15:3 (made with Neogen RK surfactant). An additional 396 g of deionized water was added to the slurry making the overall toner solids in the final slurry to equal 11%. After uniform mixing, the pH of the slurry was measured and adjusted from 4.80 to 4.0 with 0.39 grams of concentrated acetic acid. The 1.0% wt. zinc acetate dehydrate solution (1.19 g zinc acetate dehydrate in 50 g deionized water), which was adjusted from pH 6.87 to 4.03 with 2.71 g concentrated acetic acid, was added at ambient temperature via a peristaltic pump over 7 minutes to the pre-toner slurry while homogenizing the slurry with an IKA Ultra Turrax T50 probe homogenizer at 3000 rpm. As the slurry began to thicken the homogenizer rpm was increased to 4000 while shifting the beaker side-to-side. The $D_{50}$ and GSD (by volume) were measured to be 4.80 and 1.36, consecutively, with the Coulter Counter Particle Size Analyzer.

This 1.3 L solution was charged into a 2 liter Büichi equipped with a mechanical stirrer containing two P4 45 degree angle blades. The heating was programmed to reach 40° C. over 30 minutes with stirring at 800 revolutions per minute. After 3 minutes at 40° C., the $D_{50}$ particle size of the toner had already reached 6.26 μm, but as aggregates and not coalesced particles. At 11 minutes at 40° C., 6.07 g of 12.16 wt. % Neogen RK anionic surfactant were added to the toner slurry. At 22 minutes (40° C.), the pH of the slurry was adjusted from 4.19 to 6.32 with 48.95 g of 1M LiOH. After 38 minutes at 40° C., the $D_{50}$ particle size dropped to 6.13 μm. The temperature of the reactor was then increased to 50° C. and then again to 60° C.; the $D_{50}$ particle size reached 12.49 μm and were still aggregates at this point. At 112 minutes into the reaction, the temperature was increased again to 72° C.; even after 82 minutes the particles were not coalesced. The reaction was cooled overnight after a total time of 194 minutes and restarted the next day. Next day, the $D_{50}$ particle size was measured to be 10.43 μm and still not fully coalesced. The reactor was heated to 74° C. over 50 minutes to attempt to fully coalesce the particles. After 36 minutes (230 total time), the particles were still not coalesced. The set point of the reactor was increased to 76° C. and finally at a total reaction time of 269 minutes the particles coalesced into huge aggregates. The toner slurry was then allowed to cool to room temperature, about 25° C., overnight, about 18 hours, while still stirring at 800 rpm. The product was filtered through a 25 micron stainless steel screen (#500 mesh), left in its mother liquor and settled overnight. Next day the mother liquor, which contained fines, was decanted from the toner cake that settled to the bottom of the beaker. The settled toner was reslurried in 1.5 liter of deionized water, stirred for 30 minutes, and then settled again overnight. This procedure was repeated once more until the solution conductivity of the filtrate was measured to be about 18.8 microsiemens per centimeter, which indicated that the washing procedure was sufficient. The toner cake was redispersed into 400 milliliters of deionized water, and freeze-dried over 72 hours. The final dry yield of toner was minuscule and not quantified.

EXAMPLE 4

In a 2 L Nalgene beaker, 529.8 grams of 18 percent by weight of the branched 1.5% lithio-sulfonated polyester resin (Tg=61.1° C.) and 201.0 grams of 11.8 percent by weight of the crystalline 1.5% lithio-sulfonated polyester resin, both emulsified via the solvent flashing method with acetone, were mixed together. To this was added 61.0 grams of 20.7 percent by weight of a Carnauba wax dispersion, as well as 31.7 grams of a cyan pigment dispersion containing 26.5 percent by weight of Pigment Blue 15:3 (made with Neogen RK surfactant). An additional 428.6 g of deionized water was added to the slurry making the overall toner solids in the final slurry to equal 10.39%. After uniform mixing, the pH of the slurry was measured and adjusted from 4.70 to 4.0 with 0.23 grams of concentrated acetic acid. The 2.5% wt. zinc acetate dehydrate solution (2.98 g zinc acetate dehydrate in 90.2 g deionized water), which was adjusted from pH 6.73 to 4.34 with 2.66 g concentrated acetic acid, was added at ambient temperature via a peristaltic pump over 12 minutes to the pre-toner slurry while homogenizing the slurry with an IKA Ultra Turrax T50 probe homogenizer at 3000 rpm. As the slurry began to thicken the homogenizer rpm was increased to 4000 while shifting the beaker side-to-side. The $D_{50}$ and GSD (by volume) were measured to be 3.07 and 1.69, consecutively, with the Coulter Counter Particle Size Analyzer.

This 1.35 L solution was charged into a 2 liter Büichi equipped with a mechanical stirrer containing two P4 45 degree angle blades. The heating was programmed to reach 40° C. over 30 minutes with stirring at 700 revolutions per minute. After 16 minutes at 40° C., the $D_{50}$ particle size of the toner had already reached 4.14 μm, but as aggregates and not coalesced particles. At 22 minutes into the reaction, the temperature was increased to 45° C.; the $D_{50}$ particle size reached 4.80 μm after 11 minutes at this temperature. The $D_{50}$ particle size reached 6.47 μm after 11 minutes at 50° C. or 54 minutes into the reaction. After 60 minutes into the reaction, the EDTA base solution (2 g of ethylenediamine tetraacetic acid in 67.49 g of 1M NaOH as a 2.96-wt % solution) was added; the pH of the toner slurry increased from 4.57 to 5.64. The $D_{50}$ particle size only fluctuated from 7.04 to 6.97 μm after 44 minutes at 50° C. The temperature of the reactor was then increased to 55° C. and then again to 60° C.; the $D_{50}$ particle size reached 7.19 μm but were still aggregates. After 24 minutes, the temperature was further increased to 65° C. and the particles stabilized at 7 μm±0.25. The particles only started coalescing once the temperature of the slurry reached 71° C. ($D_{50}$=6.75; GSD=1.25). The reaction was turned off or heating was stopped at 72° C. with a total reaction time of 186 minutes. The toner slurry was fast cooled by replacing hot water with cold in the circulating water bath, while stirring the slurry at 700 rpm. A sample (about 0.25 gram) of the reaction mixture was then retrieved from the Büichi, and a $D_{50}$ particle size of 6.82 microns with a GSD of 1.24 was measured by the Coulter Counter. The product was filtered through a 25 micron stainless steel screen (#500 mesh), left in its mother liquor and settled overnight. The next day the mother liquor, which contained fines, was decanted from the toner cake that settled to the bottom of the beaker. The settled toner was reslurried in 1.5 liter of deionized water, stirred for 30 minutes, and then settled again overnight. This procedure was repeated once more until the solution conductivity of the filtrate was measured to be about 11.0 microsiemens per centimeter, which indicated that the washing procedure was sufficient. The toner cake was redispersed into 300 milliliters of deionized water, and freeze-dried over 72 hours. The final dry yield of toner is estimated to be 66%.

Table 2 summarizes the results for mean circularity and shape factor for each Example. Mean circularity is the ratio between the circumference of a circle of equivalent area to the particle and the perimeter of the particle itself. The more spherical the particle, the closer its circularity is to 1.00. The more elongated the particle, the lower its circularity.

TABLE 2

| Example | MEAN CIRCULARITY (SYSMEX FPIA-2100) | SHAPE FACTOR |
|---|---|---|
| 1 | 0.963 | 125-126 |
| 2 | 0.931 | >140 |
| 3 | n/a | n/a |
| 4 w/EDTA | 0.965 | 125 |

The results of the Examples indicate the following. First, pH adjustment and addition of anionic surfactant did not help slow down or halt the polyester toner particle growth. Second, it is preferred to add at least 3 wt. %, relative to resin weight, of zinc acetate as the coagulant to achieve proper incorporation of all components. Addition of smaller amounts of zinc acetate resulted in more fines. Third, the addition of EDTA as a complexing agent during the temperature ramping stage (e.g., >65° C.) significantly slows down the toner particle growth. Fourth, the use of a complexing agent also has the effect of improving circularity of the mean particle shape.

Although the invention has been described with reference to specific preferred embodiments, it is not intended to be limited thereto. Rather, those having ordinary skill in the art will recognize that variations and modifications may be made therein which are within the spirit of the invention and within the scope of the claims.

What is claimed is:

1. A method, comprising:

forming a mixture of sulfonated polyester resin, a colorant dispersion and optionally a wax dispersion, homogenizing the mixture, adding a coagulant to the mixture and aggregating the mixture to form aggregated particles, and coalescing the aggregated particles to form coalesced particles, wherein when a predetermined average particle size is achieved during the aggregation and/or coalescing step, a complexing agent that complexes with ions of the coagulant is added in an amount effective to substantially halt any further particle growth.

2. The method according to claim 1, wherein the sulfonated polyester resin is an alkali metal sulfonated polyester resin.

3. The method according to claim 1, wherein the sulfonated polyester resin is a mixture of two or more sulfonated polyester resins.

4. The method according to claim 1, wherein the sulfonated polyester resin is comprised of both amorphous sulfonated polyester resin and crystalline sulfonated polyester resin.

5. The method according to claim 4, wherein the amorphous sulfonated polyester resin is branched.

6. The method according to claim 1, wherein the sulfonated polyester is selected from the group consisting of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion. Examples of crystalline alkali sulfonated polyester based resins alkali copoly(5-sulfoisophthaloyl)-co-poly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), and alkali copoly(5-sulfo-iosphthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly (ethylene-succinate), alkali copoly(5-sulfoisophthaloyl-copoly(butylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly (butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-iosphthaloyl)-copoly(butylene-adipate), alkali copoly(5-sulfo-isophthaloyl)-copoly(pentylene-adipate), and alkali copoly(5-sulfo-isophthaloyl)copoly (hexylene-adipate), poly(octylene-adipate), and wherein the alkali is a metal of sodium, lithium or potassium.

7. The method according to claim 1, wherein the coagulant comprises a metal salt.

8. The method according to claim 1, wherein the coagulant comprises zinc acetate.

9. The method according to claim 1, wherein the complexing agent is selected from the group consisting of ethylenediamine tetraacetic acid, ethylene diamine disuccininc acid, nitrilotriacetate, methylglycinediacetic acid, glutamate-N,N-bis(carboxymethyl), carboxymethylchitosan (under biscarboxymethyl umbrella), dimercaptosuccinic acid (DMSA), diethylenetriaminepentaacetate (DTPA) and mixtures thereof.

10. The method according to claim 1, wherein the complexing agent is dissolved in a solution including about 0.5 to about 1.0 M of a base prior to addition.

11. The method according to claim 10, wherein the base comprises sodium hydroxide, potassium hydroxide, ammonium hydroxide, sodium carbonate, sodium bicarbonate or mixtures thereof.

12. The method according to claim 1, wherein the complexing agent is dissolved in a solution including a base prior to addition, and wherein the base is present in the solution in an amount of from about 0.5 to about 10 weight percent relative to the weight of the complexing agent in the solution.

13. The method according to claim 12, wherein the base comprises sodium hydroxide, potassium hydroxide, ammonium hydroxide, sodium carbonate, sodium bicarbonate or mixtures thereof.

14. The method according to claim 1, wherein the predetermined average particle size is from about 3 to about 15 micrometers.

15. The method according to claim 1, wherein the particles obtained have an average particle size of about 3 to about 15 micrometers and a geometric size distribution of about 1.05 to about 1.35.

16. The method according to claim 1, wherein the coagulant is added in an amount of from about 0.5 to about 5% by weight of the resin.

17. The method according to claim 16, wherein the complexing agent is added in an amount of from about 0.01 to about 8% by weight of solids in the mixture.

18. A method comprising:

forming a mixture of an alkali metal sulfonated polyester resin, a colorant dispersion and optionally a wax dispersion, homogenizing the mixture, adding a zinc-containing coagulant to the mixture and aggregating the mixture to form aggregated particles, and coalescing the aggregated particles to form coalesced particles, wherein when a predetermined average particle size is achieved during the aggregation and/or coalescing step, adding a complexing agent that complexes with zinc ions of the zinc-containing coagulant in an amount effective to substantially halt any further particle growth.

19. The method according to claim 18, wherein the alkali metal sulfonated polyester resin is a mixture of two or more alkali metal sulfonated polyester resins.

20. A method comprising:

forming a mixture of hydrophobic polyester resin emulsion, a colorant dispersion and optionally a wax dispersion, homogenizing the mixture, adding a zinc-containing coagulant to the mixture and aggregating the mixture to form aggregated particles, and coalescing the aggregated particles to form coalesced particles, wherein when a predetermined average particle size is achieved during the aggregation and/or coalescing step, ethylenediamine tetraacetic acid is added in an amount effective to substantially halt any further particle growth.

21. The method according to claim 20, wherein the hydrophobic polyester resin has a bimodal molecular weight distribution.

* * * * *